US006722320B1

(12) United States Patent
Pham et al.

(10) Patent No.: US 6,722,320 B1
(45) Date of Patent: Apr. 20, 2004

(54) CYLINDER LINER

(75) Inventors: Anh Ngoc Pham, Lakewood, CA (US); David Y. Nov, Laguna Niguel, CA (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 10/268,820

(22) Filed: Oct. 10, 2002

(51) Int. Cl.[7] ..... F02F 1/10

(52) U.S. Cl. ..... 123/41.84; 29/888.01

(58) Field of Search ..... 123/41.84; 29/888.01

(56) References Cited

U.S. PATENT DOCUMENTS 3,685,132 A * 8/1972 Hodge ..... 29/426.5
4,926,801 A 5/1990 Eisenbert et al.
5,299,538 A 4/1994 Kennedy

FOREIGN PATENT DOCUMENTS

GB 392091 5/1933

* cited by examiner

*Primary Examiner*—Henry C. Yuen
*Assistant Examiner*—Katrina B. Harris
(74) *Attorney, Agent, or Firm*—Howard & Howard

(57) ABSTRACT

A cylinder liner for an internal combustion engine provides a method of replacement of spent cylinder liners, wherein the cylinder liner includes a generally cylindrical body having a flange extending radially outwardly defining a shoulder. The shoulder provides a positive stop in an axial direction against a surface within a cylinder block of the engine. The body has an engagement portion adjacent the shoulder. The engagement portion is necked down from the flange and has lower and upper portions providing an interference fit within the cylinder block. The lower and upper portions of the engagement portion are separated from one another by a channel that extends substantially about the circumference of the body. The channel provides a passage for fluid flow between the lower and upper portions to facilitate cooling of the engagement portion.

13 Claims, 2 Drawing Sheets

CYLINDER LINER

BACKGROUND OF THE INVENTION

1. Technical Field

This invention relates generally to cylinder liners used in diesel engines.

2. Related Art

It is common in diesel engines to provide coolant passages between the cylinder block of the engine and its cylinder liners. While proper cooling can preclude excessive distortion of the cylinder liners, particularly in the area of a mounting flange of the liners, and also reduce the wear between the pistons and the liners, such is not easily achieved.

Many cylinder liners used in conventional diesel engines, such as those disclosed in U.S. Pat. No. 5,299,538, have an upper mounting flange that is dimensioned to provide a gap between a perimeter of the mounting flange and the wall of the block. The gap provides for expansion of the mounting flange upon being exposed to heat of combustion. To facilitate cooling of the liner in the region of the upper flange, the bottom side of the flange is brought into fluid contact with liquid coolant that flows through a coolant chamber adjacent the flange. This can lead to liquid coolant leaking past the mounting flange to the upper side of the block or other unintended locations. Also, having a cooling chamber immediately adjacent the mounting flange provides challenges to inhibiting undesirable radial movement of the mounting flange relative to the wall of the cylinder block. Radial movement of the mounting flange typically leads to a reduced life to the cylinder liner.

SUMMARY OF THE INVENTION

A cylinder liner for an internal combustion engine comprises a generally cylindrical body having a first dimension and having a flange extending radially outwardly from the first dimension defining a shoulder. The shoulder provides a positive stop in an axial direction against a surface within a cylinder block of the engine. The body has an engagement portion adjacent the shoulder. The engagement portion is necked down from the flange and extends substantially about a circumference of the body. The engagement portion has lower and upper portions providing an interference fit within the cylinder block. The interference fit inhibits fluid flow between the lower and upper portions and the cylinder block where the upper and lower portions engage the cylinder block. The lower and upper portions of the engagement portion are separated from one another by a channel. The channel extends substantially about the circumference of the body and provides a passage for fluid between the lower and upper portions to facilitate cooling of the engagement portion. The upper portion inhibits fluid from contacting the flange while at the same time inhibits radial movement of the flange relative to the cylinder block.

According to another aspect of the invention, a method is provided for replacing a spent cylinder liner in an internal combustion engine. The spent liner is removed from a cylinder block. A new replacement cylinder liner is provided having a flange defining a shoulder and an engagement portion necked down from the flange adjacent the shoulder. The engagement portion extends substantially about a circumference of the replacement liner and comprises lower and upper portions separated from one another by a channel. The channel extends substantially about the circumference of the liner. The replacement liner is pressed into the cylinder block to seat the shoulder of the flange against a stop surface of the cylinder block to limit axial movement of the liner. An interference fit is provided between the lower and upper portions of the engagement portion and the cylinder block at a location spaced below the flange to inhibit radial movement of the liner and to provide a fluid-tight seal for the flow of coolant in the channel.

One advantage of the present invention is providing a cylinder liner that prevents fluid from contacting and thus leaking past a flange of the cylinder liner.

Another advantage of the present invention is that the flange is inhibited from radial movement, thereby reducing the amount of wear to the liner as well as the block counterbore and providing the liner and the block with an extended life in use.

BRIEF DESCRIPTION OF THE DRAWINGS

These and other features and advantages of the invention will become more readily appreciated when considered in connection with the following detailed description and appended drawings, wherein.

DETAILED DESCRIPTION OF A PREFERRED EMBODIMENT

Figure 1:
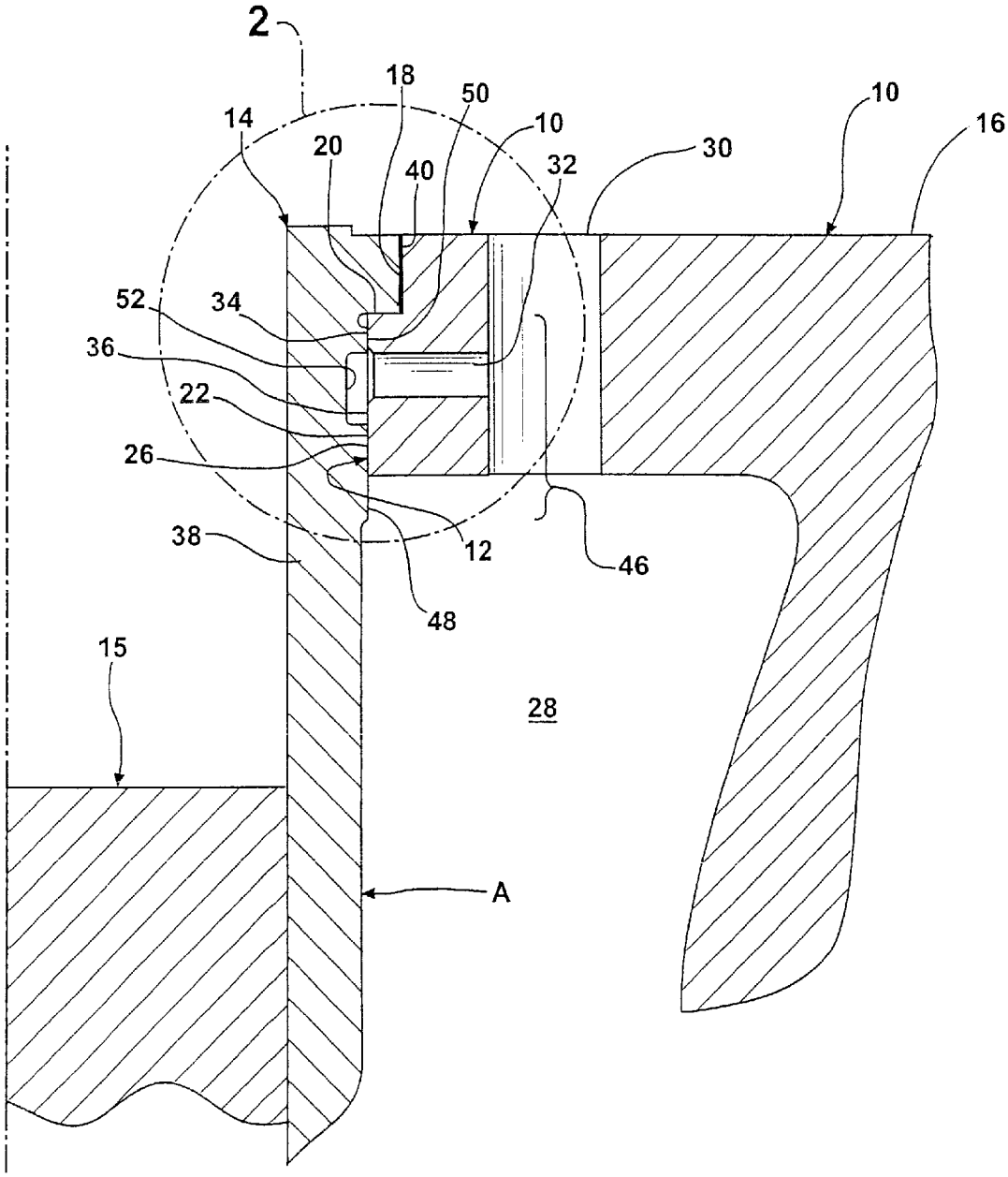
FIG. 1 is a fragmentary cross-sectional view of an engine taken axially through a cylinder liner embodying a presently preferred construction of the invention assembled within an engine block.
Figure 2:
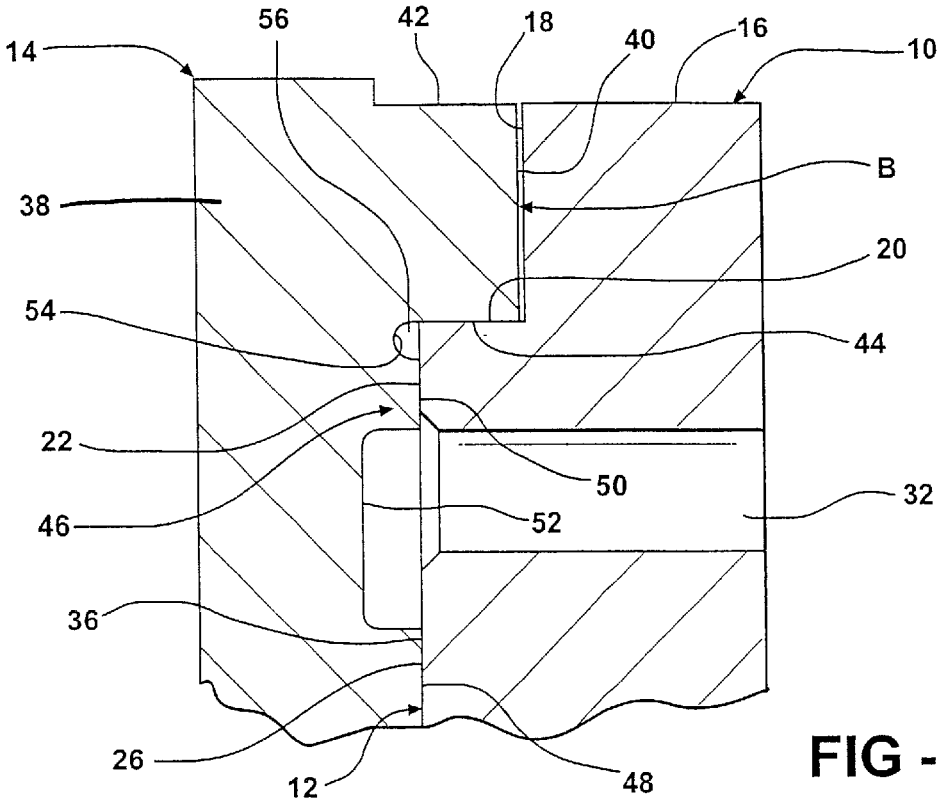
FIG. 2 is an enlarged view of the circled region 2 of FIG. 1 showing the mating relationship between the cylinder liner and the cylinder block.

As shown in FIGS. 1 and 2, a cylinder block, represented here as a diesel cylinder block 10, has a cylinder bore 12 sized to receive a replaceable cylinder liner 14.

Figure 3:
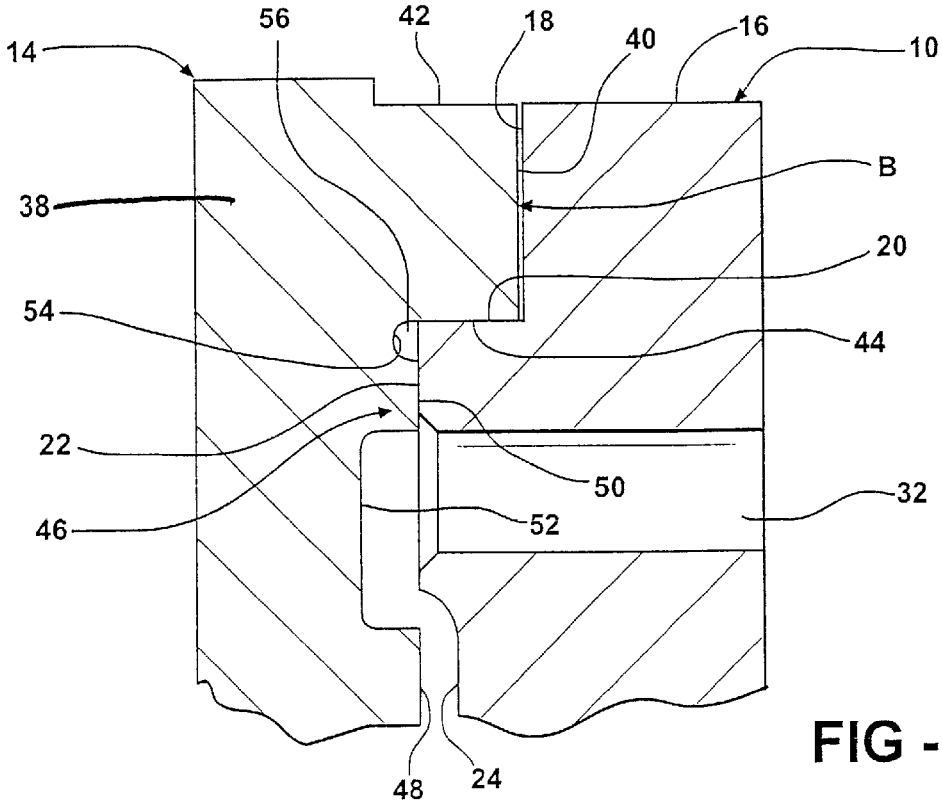
FIG. 3 is a fragmentary sectional view of the liner shown installed in the block.

The cylinder block 10 is similar to that as shown in U.S. Pat. No. 5,299,538 to Kennedy, the disclosure of which is incorporated herein by reference. The cylinder block 10 has an upper surface 16 for mating with a cylinder head (not shown). A counter bore 18 extends downwardly from the upper surface 16 of the block 10 to a predetermined depth forming a bottom surface 20 of the counter bore 18. From the bottom surface 20, an inner radial wall 22 having a diameter less than the diameter of the counter bore 18 extends downwardly to a predetermined depth to accommodate receiving the cylinder liner 14. As shown in FIG. 3, within the inner radial wall 22, coolant ribs or scallops 24 are formed therein to facilitate fluid flow between the inner radial wall 22 of the cylinder block 10 and the cylinder liner 14. The scallops 24 are preferably spaced radially about the circumference of the inner radial wall 22 providing for non-scalloped regions 26 between the scallops 24.

Within the cylinder bore 12, and below the scallops 24, a main coolant chamber 28 surrounds the greater portion of the cylinder liner 14. A coolant fluid is circulated within the main coolant chamber 28 from an inlet port (now shown) and ultimately exits an outlet port 30. In addition to flowing between the main coolant chamber 28 and exiting the outlet port 30, the fluid flows through the scallops 24 and through ports 32 extending transversely through the inner radial wall 22. The ports 32 extend into the outlet ports 30 so that the fluid can exit therethrough. Therefore, the ports 32 are formed between an upper portion of 34 of the inner radial wall 22 and a lower portion 36 of the inner radial wall 22. The upper portion 34 is void of the scallops 24, whereas the lower portion 36 is formed with the scallops 24.

The cylinder liner 14 has a generally cylindrical body 38 having a first dimension represented as a diameter A and having a flange 40 extending radially outwardly from the diameter A. As shown in FIGS. 2 and 3, the flange has an upper surface 42 and a lower surface or shoulder 44 providing a positive stop in an axial direction against the bottom surface 20 of the cylinder block 10 upon assembly the cylinder liner 14 within the cylinder block 10.

Adjacent the shoulder 44, an engagement portion 46 extends downwardly from the shoulder 44 substantially about a circumference of the body 38. The engagement portion 46 is necked down from the flange 40. The engagement portion 46 is divided into lower and upper portions 48, 50, respectively, by a channel 52 extending substantially about the circumference of the body 38. The lower and upper portions 48, 50 are preferably sized to provide a fluid tight and preferably interference fit against the lower portion 36 and the upper portion 34, respectively.

The interference fit inhibits fluid flow between the lower and upper portions 48, 50 and the cylinder block 10 where the upper and lower portions 50, 48 engage the cylinder block 10. The scallops 24 in the cylinder block 10 allow fluid to pass between the lower portion 48 and the cylinder block 10. Additionally, the upper portion 50 inhibits fluid from contacting the flange 40, and further inhibits radial movement of the flange 40 relative to the counter bore 18 of the cylinder block 10.

Preferably, the channel 52 is formed within the engagement portion 46 such that the upper portion 50 extends in axial length less than the lower portion 48, thus providing the proper axial alignment of the channel 52 relative to the ports 32 in the cylinder block 10. The channel 52 extends in axial length from the upper portion 50 to a point substantially one-third the axial length of the engagement portion 46. This helps to ensure that the channel 52 is in alignment with the ports 32 upon assembly of the cylinder liner 14 within the cylinder bore 12. The channel 52 provides for fluid flow between the lower and upper portions 48, 50 to facilitate cooling of the engagement portion 46 to inhibit distortion of the cylinder liner 14, and thus reducing the amount of wear that results to the cylinder liner 14 in use.

Preferably, a radially recessed groove 54 is formed between the upper portion 50 and the shoulder 44 defined by the flange 40. The recessed groove 54 is separate from the channel 52 and is intended to remain free from fluid contact. The groove 54 facilitates manufacture of the cylinder liner 14 and acts to eliminate stress risers between the upper portion 50 and the shoulder 44. The groove 54 also provides an air pocket 56 between the upper portion 50 and the flange 40 further inhibiting fluid from flowing past the flange 40. By chance, should fluid reach the pocket 56, the fluid is inhibited from flowing past the flange 40 and into a combustion chamber (not shown).

As best shown in FIGS. 2 and 3, the flange 40 preferably has an outer dimension represented as a diameter B that is sized to provide a loose fit between the flange 40 and the counter bore 12. By providing for clearance or gap between the flange 40 and the cylinder block 10, expansion of the flange 40 within the gap is permitted in elevated heat conditions, thus preventing distortion of the flange 40 that could otherwise result from interference of the flange 40 with the cylinder block 10.

During initial build or rebuild of an engine the cylinder liners 14 are inserted within the cylinder block 10 bringing the upper portion 50 into radial contact with the wall 22 of the block. Having portion 50 adjacent the flange 14 and in radial contact with the wall 22 prevents radial movement of the flange 14 relative to the cylinder block 10. This allows for a design utilizing a loose fit between the upper flange 40 of the liner 14 and the cylinder block 10 to provide an expansion gap to accommodate radial expansion of the flange 40 when exposed to the heat of combustion. Further, the upper portion 50, in combination with the air pocket 56, inhibits fluid from contacting the flange 40, which in turn, inhibits fluid from leaking between the flange 40 and the cylinder block 10 and into the combustion chamber (not shown).

Obviously, many modifications and variations of the presently preferred construction of the invention are possible in light of the above teachings. It is, therefore, to be understood that within the scope of the appended claims, the invention may be practiced otherwise than as specifically shown and described. The invention is defined by the claims.

What is claimed is:

1. A cylinder liner for an internal combustion engine, comprising:

a generally cylindrical body having a flange extending radially outwardly of the body defining a bottom stop shoulder;

an engagement portion of said body disposed below said shoulder, said engagement portion being radially smaller than said flange and extending substantially about a circumference of said body, said engagement portion having lower and upper portions providing an interference fit within a wall of a cylinder block; and a coolant channel extending substantially about the circumference of said body between said lower and upper portions of said engagement portion.

2. The cylinder liner of claim 1 wherein said engagement portion has an axial length and said channel extends axially from said upper portion along a distance equal to about one-third the axial length of said engagement portion.

3. The cylinder liner of claim 1 further comprising a radially recessed groove provided between said upper portion of said engagement portion and said shoulder.

4. The cylinder liner of claim 3 wherein said radially recessed groove provides an air pocket between said upper portion and said flange.

5. The cylinder liner of claim 1 wherein said upper portion is axially shorter than said lower portion.

6. An engine, comprising:

an engine block having a cylinder bore with a cylinder bore wall of predetermined diameter and a flange counter bore adjacent a top surface of said block having a radially extending stop surface and a circumferentially extending counterbore wall of relatively greater diameter than that of said cylinder bore wall;

a cylinder liner having a main body disposed in said cylinder bore and a top flange disposed in said flange counter bore having a bottom stop shoulder engaging said counter bore to suspend said liner within said block, said main body including an engagement portion disposed below said top flange engaging said cylinder bore wall and defining a fluid-tight fit to isolate said top flange from exposure to liquid engine coolant and supporting said cylinder liner against radial movement relative to said block independently of said flange.

7. The engine of claim 6 wherein said flange is radially spaced from said counterbore wall to define a radial expansion gap between said flange and said block.

8. The engine of claim 6 including a coolant channel formed in said engagement portion separating said engagement portion into upper and lower regions.

9. The engine of claim 8 including an air channel separating said engagement portion from said flange and isolated from said coolant channel.

10. A method of replacing a spent cylinder liner of an internal combustion engine, comprising:

removing the spent cylinder liner from a cylinder block of the engine;

providing a replacement cylinder liner having a top flange defining a bottom stop shoulder and having an engagement portion necked down from the flange below the shoulder such that the engagement portion extends substantially about a circumference of the replacement cylinder liner and comprises lower and upper portions separated from one another by a channel extending substantially about the circumference of the replacement cylinder liner;

pressing the replacement cylinder liner into the cylinder block to provide positive engagement in an axial direction between the shoulder and a surface of the cylinder block, to provide an interference fit between the lower and upper portions and the cylinder block inhibiting fluid flow where the upper and lower portions engage the cylinder block, and to provide fluid flow within the channel between the lower and upper portions facilitating cooling of the engagement portion and the upper portion both inhibiting fluid within the channel from contacting the flange and inhibiting radial movement of the flange relative to the cylinder block.

11. The method of claim 10 further comprising constructing the channel extending in axial length from the upper portion to a point substantially one-third the axial length of the engagement portion.

12. The method of claim 10 further comprising constructing a radially recessed groove between the upper portion of the engagement portion and the shoulder defined by the flange to provide an air pocket between the upper portion and the flange inhibiting fluid from flowing past the flange.

13. The method of claim 10 further comprising constructing the upper portion extending in axial length less than the lower portion to facilitate axial alignment of the channel relative to a fluid passage in the cylinder block.

* * * * *